United States Patent [19]

Sakamoto et al.

[11] 4,300,655

[45] Nov. 17, 1981

[54] ACOUSTIC DIAPHRAGM FOR SPEAKERS AND METHOD OF PRODUCING THE SAME

[75] Inventors: Naraji Sakamoto, Kawanishi; Shuji Saiki, Amagasaki; Kazue Sato, Kadoma; Kousaku Murata, Kobe; Hiroshi Yamamoto, Katano, all of Japan

[73] Assignee: Matsushita Electric Industrial Co., Ltd., Osaka, Japan

[21] Appl. No.: 151,649

[22] Filed: May 20, 1980

[30] Foreign Application Priority Data

May 31, 1979 [JP] Japan ..... 54-68424

[51] Int. Cl.[3] ..... H04R 7/08

[52] U.S. Cl. ..... 181/167; 179/181 R

[58] Field of Search ..... 179/115 R, 138, 181 R, 179/181 F, 181 W; 181/157, 167–170

[56] References Cited

U.S. PATENT DOCUMENTS

Re. 24,141 4/1956 Brennan ..... 181/169
1,740,651 12/1929 Huether ..... 181/170 X
2,624,417 1/1953 Brennan ..... 181/169

FOREIGN PATENT DOCUMENTS 133125 10/1979 Japan ..... 179/181 R
1526201 9/1978 United Kingdom ..... 181/170

*Primary Examiner*—L. T. Hix
*Assistant Examiner*—Thomas H. Tarcza
*Attorney, Agent, or Firm*—Spencer & Kaye

[57] ABSTRACT

An acoustic diaphragm for speakers having a sandwich structure constituted by a core material comprising an elongated web material bent to have a plurality of radial projections, and upper and lower surface members adhered to the upper and lower edges of the core member, as well as a method of producing the same. The acoustic diaphragm of the invention has a reduced weight while exhibiting a large flexural rigidity so that the nodal line during the resonance vibration can have a circular form which in turn offers a circular form of nodal line and increased speaker power. Also, the method of producing the invention permits easy fabrication of the acoustic diaphragm having a sandwich structure.

3 Claims, 10 Drawing Figures

ACOUSTIC DIAPHRAGM FOR SPEAKERS AND METHOD OF PRODUCING THE SAME

BACKGROUND OF THE INVENTION

The present invention relates to a method of producing an acoustic diaphragm constituted by a core member made of a web material such as metal foil and surface materials adhered to both surfaces of the core member, as well as to a method of producing the same. More particularly, the invention aims at providing an acoustic diaphragm having an enlarged reproducible frequency range and a flat frequency characteristic to improve the efficiency of the speaker, as well as to a method of producing such an acoustic diaphragm.

Conventional acoustic diaphragms for speakers have a core member of a honey-comb structure consisting of a multiplicity of laminated metal foils, the adjacent metal foils being adhered at a regular pitch. In this conventional acoustic diaphragm, because of a directionality of rigidity of the honey-comb core member, the nodal line generated during resonance of the diaphragm takes an oval shape. As a result, the nodal points in the direction of the major axis of the oval shape are positioned outside the voice coil of the acoustic diaphragm, whereas the nodal points in the direction of the minor axis of the oval shape are positioned inside of the voice coil.

For this reason, in the conventional acoustic diaphragm, a peak of sound pressure is generated at the resonance frequency of the acoustic diaphragm and the range of flat sound pressure level is inconveniently narrowed.

In order to overcome this problem it has been proposed to increase the resonance frequency so as to enlarge the flat sound pressure range, by adopting a voice coil bobbin having an oval cross-section. When the coil bobbin having an oval cross-section is used, the voice coil also has an oval shape which in turn necessitates a magnetic circuit having an oval magnetic gap. In consequence, the production process is impractically complicated and the cost of production of such a speaker is raised uneconomically.

SUMMARY OF THE INVENTION

It is, therefore, a major object of the invention to provide an acoustic diaphragm capable of eliminating the aforementined drawbacks of the conventional acoustic diaphragm for speakers.

To this end, according to an aspect of the invention, there is provided an acoustic diaphragm for speakers comprising a core member constituted by a continuous elongated web material and surface members adhered to the upper and lower edges of the core member, wherein the elongated web constituting the core member is bent alternatingly and successively at the central portion of the surface members and at the peripheral portion of the same to extend alternatingly radially inwardly and outwardly, so that the web as a whole is arranged to have a plurality of portions extending radially outwardly.

According to another aspect of the invention. there is provided a method of producing an acoustic diaphragm for speakers, comprising the steps of preparing a carrier plate having a plurality of pins provided thereon and arranged on two concentric circles of small and large diameters centered at a point on the carrier plate, stretching an elongated web material between the pins such that the web is flexed alternatingly at the pin on the circle of smaller diameter and at the pin on the larger diameter to have portions projected radially outwardly, adhering a surface material to the upper edge of the flexed web material, withdrawing the web material from the pins and then adhering another surface material to the lower edge of the web.

These and other objects, as well as advantageous features of the invention will become more clear from the following description of the preferred embodiments taken in conjunction with the accompanying drawings.

DETAILED DESCRIPTION OF THE PREFERRED EMBODIMENTS

Before turning to the description of the preferred embodiments, a description will be made hereinunder as to the conventional acoustic diaphragm, with specific reference to FIGS. 1 to 4, in order to clarify the drawbacks of the prior art and, hence, the technical subject to be achieved by the invention.

Figure 1:
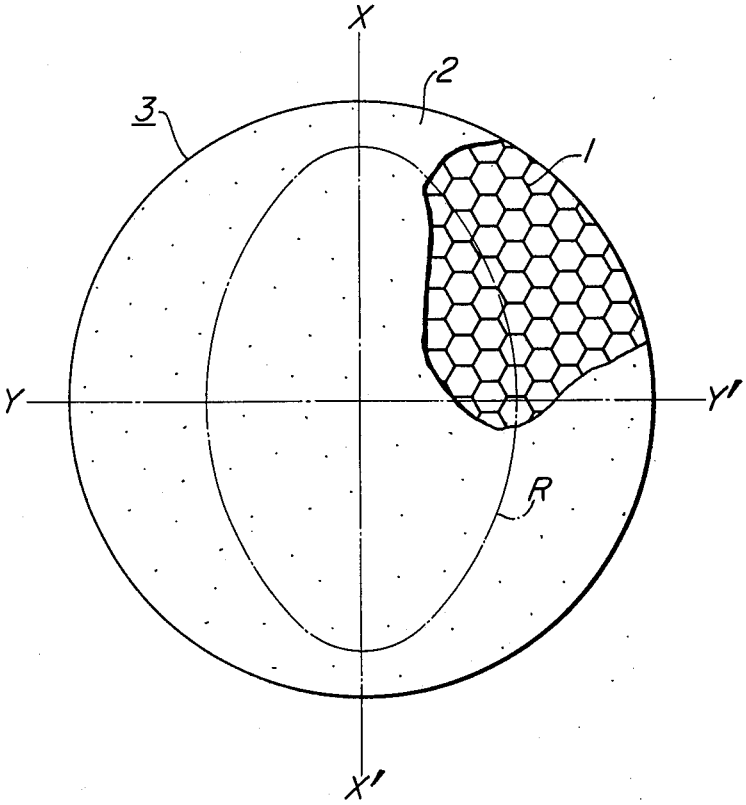
FIG. 1 PRIOR ART
FIG. 1 is a plan view of a conventional acoustic diaphragm of a speaker with a part thereof removed.
Figure 2:
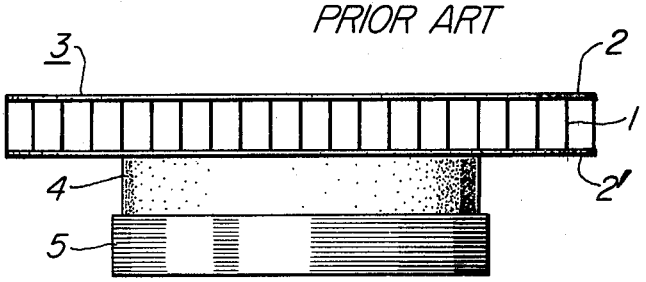
FIG. 2 PRIOR ART
FIG. 2 is a side elevational view of the acoustic diaphragm shown in FIG. 1.

Referring first to FIGS. 1 and 2 showing a typical conventional diaphragm for speakers, a honey-comb core is made of a multiplicity of metal foils laminated and adhered to adjacent ones at a regular pitch to have a multiplicity of hexagonal cells. Reference numerals 2, 2' denote surface members adhered to the upper and lower sides of a honey-comb core member 1. The honey-comb core member 1 and the surface members 2, 2' in combination constitute a planar diaphragm 3 of a sandwich structure.

Referring to FIG. 2, a voice coil bobbin 4 having a cylindrical form is attached to the lower side of the diaphragm 3. A voice coil 5 is constituted by wires wound round the coil bobbin 4. A conventional speaker is constructed by supporting the diaphragm 3 at its outer peripheral part by means of a frame through an annular edge member, supporting the coil bobbin by means of a damper and inserting the voice coil 5 into the magnetic gap of the magnetic circuit.

In the conventional diaphragm for speakers having the described construction, however, the nodal line inconveniently has an oval shape as represented by R in FIG. 1, due to the directionality of the rigidity of honey-comb core member 1.

Figure 3A:
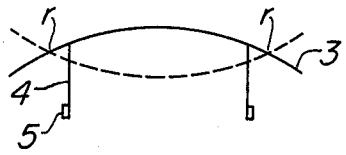
FIG. 3A PRIOR ART
FIGS. 3A and 3B are illustrations showing the state of vibration of the conventional acoustic diaphragm.
Figure 3B:
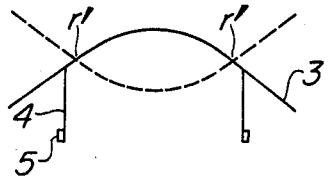
FIG. 3B PRIOR ART

FIGS. 3A and 3B show the state of the diaphragm in resonance vibration, in the X—X and Y—Y directions, respectively.

As will be clearly understood from FIGS. 3A and 3B, the nodal points r, r in the X—X direction and nodal points r', r' in the Y—Y direction are located at the outside and inside, respectively, of the area of attachment of the voice coil bobbin 4.

Figure 4:
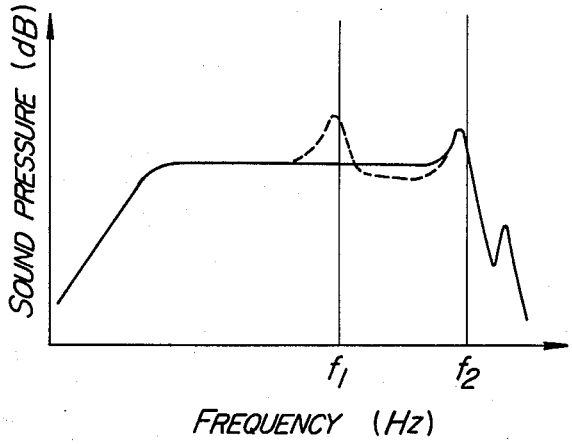
FIG. 4 is a sound pressure-frequency characteristic of a speaker incorporating a conventional acoustic diaphragm.

In consequence, the sound pressure-frequency characteristic of a speaker using the diaphragm 3 shown in FIGS. 1 and 2 inevitably involves a peak of the sound pressure level at the resonance frequency $f_1$, as shown by the broken line in FIG. 4, and the flat region of the sound pressure level of this speaker is considerably narrowed.

It has been proposed also to use a coil bobbin having an oval cross-section and to attach the same to the diaphragm to meet the oval nodal line R. In such a case, the resonance frequency can be increased to $f_2$ and the reproducible range can be increased by about 4 times as compared with the case of the resonance frequency $f_1$. The use of a coil bobbin having an oval cross-section, however, necessitates an oval voice coil, as well as a magnetic circuit having an oval magnetic gap, resulting in difficulty in the production of the speaker and, hence, an increased cost of production of the same.

The above-described problems of the prior art, however, are fairly overcome by the present invention, as will be fully realized from the following description.

Figure 5:
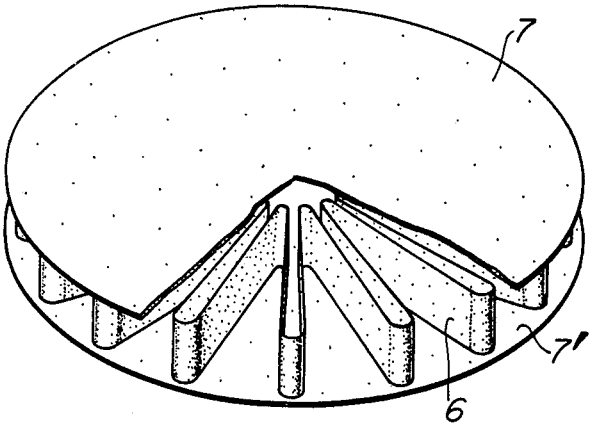
FIG. 5 is a perspective view of an acoustic diaphragm for speakers in accordance with the invention with a part thereof removed.

Referring to FIG. 5, reference numeral 6 denotes an elongated web material which may be a metal foil made of aluminum, titanium or the like, or a plastic tape made of polyester, polyvinyl chloride or the like. The elongated web 6 is arranged between surface members 7, 7', and bent or turned at radially inner positions on a small circle line and at radially outer positions on a large circle line successively and alternatingly so as to have portions projected radially outwardly, which small and large circle lines are centered on the center of the surface members 7, 7'. The web 6 thus shaped is adhered at its upper and lower edges to the surface members 7, 7'.

Figure 6:
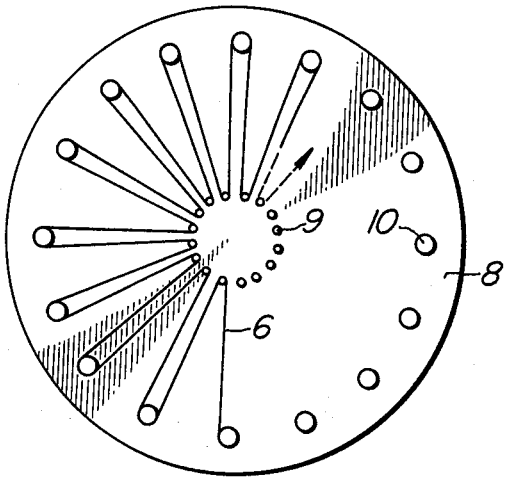
FIG. 6 is a top plan view of a jig for carrying out the method of the invention.

This diaphragm of the invention can be produced by a process which will be described hereinunder with specific reference to FIG. 6. A plurality of pins 9 are provided on a carrier 8 along a circle of a smaller diameter centered on a point on the carrier 8. Also, pins 10 are arranged on the same surface of the carrier 8 along a circle of a comparatively large diameter and centered on the same point. The pins 10 have a height smaller than the width of the web 6. For producing the diaphragm of the invention, the web 6 is continuously wound round the pins 9, 10 such that the web is bent or turned at each pin 9 on the circle of smaller diameter and at each pin 10 on the circle of larger diameter, successively and alternatingly, to have a plurality of portions projected radially outwardly. Then, an adhesive tape having a circular form is placed on the upper edge of the web 6 and, thereafter, a surface member is mounted on the adhesive tape. Thereafter, heat and pressure are applied to fuse the adhesive sheet, thereby adhering the upper edge of the web 6 to the surface member at a right angle to the latter. Then, the web 6 is withdrawn together with the surface member from the pins 9, 10, and a similar surface member is attached and adhered to the remaining side of the web 6, thereby completing production of the diaphragm.

Figure 7:
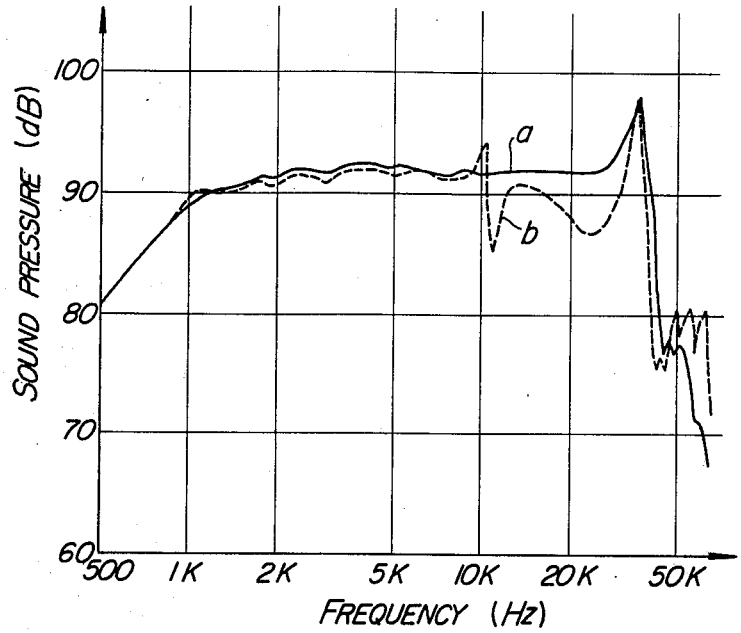
FIG. 7 shows the sound pressure-frequency characteristics of speakers incorporating the conventional acoustic diaphragm and an acoustic diaphragm of the invention.

FIG. 7 shows the sound pressure-frequency characteristic of a speaker incorporating the diaphragm of the invention, in comparison with that of a speaker having the conventional diaphragm shown in FIG. 1. More specifically, the curve designated by the symbol a shows the characteristic observed in the speaker having the diaphragm of the invention, while the curve designated at b is the characteristic observed in the speaker having the conventional diaphragm.

The diaphragms used in these speakers have a common diameter of 28 mm and a common thickness of 1 mm. Also, aluminum foils of 20$\mu$ thickness are used as the materials of the core and surface members. The voice coil in each speaker has a diameter of 19 mm which coincides with the diameter of the nodal line in the resonance state of the diaphragm of the invention.

As shown by the curve b, a peak due to resonance vibration of the diaphragm is observed at 10 KHz in the speaker incorporating the conventional diaphragm, whereas, in the speaker using the diaphragm of the invention, a peak attributable to the resonance vibration of the diaphragm is observed at a point near 35 KHz which is about 3.5 times as high as that of the speaker using the conventional diaphragm, as will be clearly understood from curve a. Thus, it is understood that a speaker using the diaphragm of the invention has an enlarged range of frequencies over which it will reproduce sound.

This is because the diaphragm of the invention has a uniform flexural rigidity in the circumferential direction to form a circular nodal line and because the circular nodal line is driven by the coil bobbin having a circular shape conforming to this nodal line. In addition, the diaphragm of the invention has a weight of 135 mg which is comparatively small as compared with the conventional diaphragm weighing about 150 mg. In consequence, the speaker incorporating the diaphragm of the invention can exhibits a performance which is about 0.5 dB higher than that of the conventional speaker.

Figure 8:
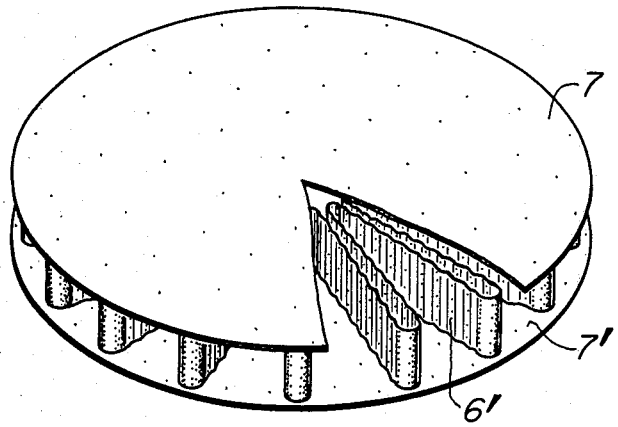
FIG. 8 is a perspective view of an acoustic diaphragm for speakers constructed in accordance with another embodiment of the invention with a part thereof removed.

Referring now to FIG. 8 showing another embodiment of the invention, a web 6' which is beforehand shaped in a corrugated form is used as the core member. In consequence, the flexural rigidity of the diaphragm in the circumferential direction is further increased.

Figure 9:
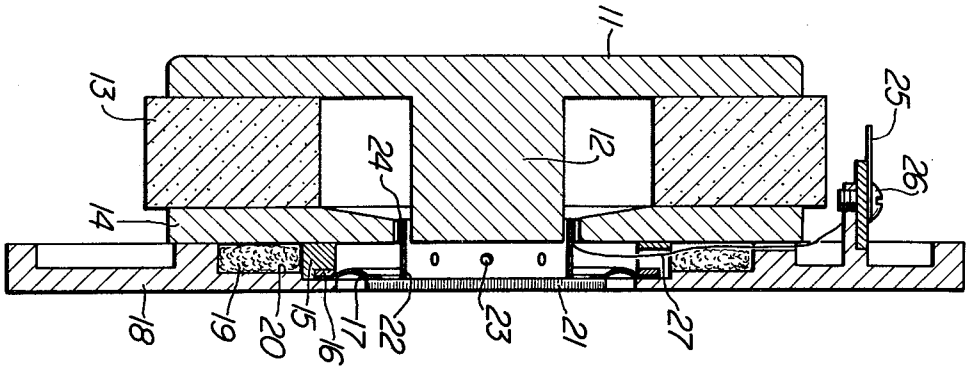
FIG. 9 is a sectional view of a speaker incorporating a diaphragm of the invention.

FIG. 9 shows in section a speaker incorporating a diaphragm of the invention. More specifically, the speaker has a yoke 11 having a columnar center pole 12 unitarily formed on the center thereof to extend upward therefrom. An annular magnet 13 is fixed to the upper face of the yoke 11, while an annular plate 14 is fixed to the upper surface of the magnet 13. An annular magnetic gap is defined between the inner peripheral surface of the annular plate 14 and the outer peripheral surface of the aforementioned center pole 12. A reference numeral 15 denotes a center ring fixed to the upper face of the plate 14 and having an annular groove formed in the upper surface thereof.

The groove receives a ring 16 having an upper surface. An annular edge member 17 is adhered to the peripheral portion of the ring 16.

A reference numeral 18 denotes a baffle plate fixed to the upper surface of the plate 14. The arrangement is such that the ring 16 is clamped between the baffle plate 18 and the center ring 15. A sound-absorbing member 19 is received by an annular recess 20 formed in the lower surface of the baffle plate 18. The aforementioned edge member 17 is adhered at its inner peripheral portion to the lower peripheral portion of the diaphragm of the invention which is generally designated by a reference numeral 21. A reference numeral 22 denotes a cylindrical coil bobbin fixed to the lower side of the diaphragm 21. The coil bobbin 22 is provided with a bore 23 for relieving air. The coil bobing 22 is fixed to the diaphragm 21 at a portion of the latter conforming to the nodal line of the primary resonance of the diaphragm 21. A voice coil 24 formed around the coil bobbin 22 is disposed in the magnetic gap. A reference numeral 25 denotes a terminal which is secured to a lug formed on the lower face of the baffle plate 18, by means of screws 26. The lead wires 27 of the voice coil 24 are connected to the terminal 25.

The electric signal representative of sound, applied to the terminal 25, is imposed on the voice coil 24 through the lead wires 27, to cause a unitary vibration of the coil bobbin 22 and the diaphragm 21, thereby radiating sound.

The acoustic diaphragm of the invention having the described construction offers various advantages as summarized below.

(1) Since the diaphragm exhibits a uniform flexural rigidity in the circumferential direction, the nodal line during the resonance vibration can have a circular form which is suitable for driving by a cylindrical coil bobbin, so that the speaker can have a wider frequency range for reproduction.

(2) The diaphragm can have an increased flexural rigidity because the tape is adhered to the surface material at a right angle.

(3) Because the web is stretched to have portions extended radially outwardly, the overall length of the web used in the diaphragm is much smaller than that of the conventional diaphragm, so that the weight is reduced and the performance of the speaker is very much improved.

(4) The production of the core member is very much facilitated as compared with the case of the honeycomb structure which necessitates a bonding of adjacent foils at a multiplicity of points.

Although the invention has been described through its preferred forms, it is to be noted here that the described embodiments are for illustrative purpose, and various changes and modifications may be imparted thereto without departing from the scope of the invention which is limited solely by the appended claims.

What is claimed is:

1. An acoustic diaphragm for speakers having a sandwich structure constituted by a core member made of an elongated web and surface members adhered to the upper and lower edges of said web, characterized in that said web is alternatingly and successively turned at radially inner and outer portions of said surface members to have portions projected radially outwardly.

2. An acoustic diaphragm for speakers as claimed in claim 1, wherein a corrugated web is used as the material of said core member.

3. A method of producing an acoustic diaphragm for speakers comprising the steps of: preparing a carrier having a plurality of pins arranged on each of a circle of a small diameter and a circle of a large diameter, said circles being centered at a common point on said carrier; stretching an elongated web between said pins such that said web is turned successively and alternatingly at the pins on said circle of small diameter and said circle of large diameter thereby to form a plurality of portions of web projected radially outwardly; adhering a surface member to the upper edge of said web; withdrawing said web from said pins; and adhering another surface member to the lower edge of said web.

* * * * *